United States Patent [19]

Albrecht et al.

[11] Patent Number: 4,656,795

[45] Date of Patent: Apr. 14, 1987

[54] FLOOR PANEL FOR ELEVATED FLOOR ASSEMBLY

[75] Inventors: Raymond E. Albrecht, Sewickley; Rodney W. Gartner, Coraopolis; John O. Hazen, Monaca; Robert G. Lindner, Sewickley, all of Pa.

[73] Assignee: H. H. Robertson Company, Pittsburgh, Pa.

[21] Appl. No.: 676,450

[22] Filed: Nov. 29, 1984

Related U.S. Application Data

[63] Continuation of Ser. No. 502,897, Jun. 10, 1983, abandoned.

[51] Int. Cl.[4] ..... E04B 5/58

[52] U.S. Cl. ..... 52/126.6; 52/263; 52/393; 52/717.1; 52/821

[58] Field of Search ..... 52/122.1, 126.5, 126.6, 52/126.7, 222, 241, 242, 243.1, 262, 263, 290, 393, 631, 678, 716, 717, 821, 822, 823, 828, 829, 830, 592, 762, 394; 248/354.3, 354.4, 357

[56] References Cited

U.S. PATENT DOCUMENTS

| | | | |
|---|---|---|---|
| 3,080,022 | 3/1963 | Mote | 52/222 |
| 3,124,222 | 3/1964 | Mote | 52/395 |
| 3,150,748 | 9/1964 | Liskey, Jr. | 52/481 |
| 3,180,460 | 4/1965 | Liskey, Jr. | 52/126.6 |
| 3,236,018 | 2/1966 | Graham et al. | 52/794 |
| 3,290,853 | 12/1966 | Pucci et al. | 52/829 |
| 3,396,501 | 8/1966 | Tale | 52/173 R |
| 3,455,080 | 7/1969 | Meadows | 52/716 |
| 3,490,178 | 1/1970 | Voisin | 52/731 |
| 3,564,794 | 2/1971 | Price | 52/222 |
| 3,681,882 | 8/1972 | Bettinger | 52/126.6 |
| 3,759,005 | 9/1973 | Smith | 52/829 |
| 3,974,616 | 8/1976 | Beckley | 52/282 |
| 4,279,109 | 7/1981 | Madl, Jr. | 52/263 |
| 4,295,318 | 10/1981 | Griffen | 52/693 |
| 4,438,610 | 3/1984 | Fifer | 52/263 |

FOREIGN PATENT DOCUMENTS

| | | | |
|---|---|---|---|
| 720024 | 10/1965 | Canada | 52/829 |
| 2054619 | 8/1971 | Fed. Rep. of Germany | 52/126.6 |
| 1286347 | 12/1962 | France | 52/64 |
| 2268922 | 12/1975 | France | 52/393 |
| 624168 | 7/1981 | Liechtenstein | 52/263 |
| 1266963 | 3/1972 | United Kingdom | 52/126.6 |
| 1432075 | 4/1976 | United Kingdom | 52/126.6 |

*Primary Examiner*—John E. Murtagh
*Assistant Examiner*—Andrew Joseph Rudy
*Attorney, Agent, or Firm*—G. E. Manias

[57] ABSTRACT

A floor panel for use in elevated floor assemblies, having a unique flexible edge construction including a relatively thin, flexible strip extending around the entire perimeter of the panel and projecting laterally outwardly from contiguous side and end faces of the panel. Plural panels supported on spaced pedestals are disposed in side-by-side relation with adjacent side and end faces spaced from each other but with adjacent flexible strips in edge-overlapped relation.

12 Claims, 14 Drawing Figures

FLOOR PANEL FOR ELEVATED FLOOR ASSEMBLY

CROSS-REFERENCES TO RELATED APPLICATIONS

This is a continuation of application Ser. No. 502,897 filed June 10, 1983 now abandoned.

BACKGROUND OF THE INVENTION

1. Field of the Invention

This invention relates generally to floor panels, and more particularly to floor panels for use in elevated floor assemblies.

2. Description of the Prior Art

Elevated floor assemblies, also called full access floor assemblies, are becoming more popular in today's building construction. Such assemblies provide a large chamber directly beneath the elevated floor in which mechanical equipment, conditioned air ducts, electrical ducts and the like are housed. The chamber also may serve as a plenum through which conditioned air is delivered to or removed from the various rooms of the building. Elevated floor assemblies comprise a plurality of pedestals which are uniformly distributed over a previously completed floor surface, such as, a concrete pad or slab. The pedestals cooperate in supporting the floor panels. The floor panels, acting as a group, provide a relatively flat, high-strength floor which sustains walking and standing of personnel, supports the apparatus and furnishings of the room, and supports moving loads as apparatus and furnishings are introduced into the room or are altered and replaced.

The floor panels preferably are individually removable to provide ready access to the chamber therebeneath. In addition, the panel-to-panel joints preferably are substantially air-tight to reduce air losses when the chamber is used as an air distributing plenum, and to reduce transmission of air-borne sound in the chamber through the joint to the room above. Attempts have been made to satisfy the seemingly inconsistent requirements of ready removability and a substantially air-tight joint.

For example, an edge or finishing strip formed from yieldable material, has been provided around the perimeter of the floor panel, see U.S. Pat. Nos. 3,236,018 (GRAHAM et al) and 4,295,319 (GRIFFIN). The finishing strip presents a vertical face which engages the vertical face presented by the trim member of adjacent panels thereby providing the desired sealed joint. However, the relatively large area of contact between the vertical faces inhibits easy removal of the panel.

In other examples, an edge or finishing strip is provided wherein the face is tapered or chamfered to reduce the area of contact between adjacent panels, see U.S. Pat. Nos. 3,396,501 (TATE) and 4,279,109 (MADL, JR.). While the area of contact is reduced thereby facilitating panel removal, the possibility exists that an air seal is not formed between adjacent panels particularly in that instance where one floor panel is smaller in lateral dimensions than the adjacent panel. The MADL, JR. '109 reference attempts to overcome the problem introduced by panel size variations by providing cooperating indexing members on the bottom surface of the panel and the top surface of each pedestal. The cooperating indexing members are said to exactly position the panels with respect to each other to assure panel alignment and a properly sealed joint between adjacent panels. The MADL, JR. '109 arrangement requires precise positioning of the indexing members on each pedestal and requires precise positioning of the cooperating indexing members on each panel—such precision work adding significantly to the cost of manufacturing and hence the overall cost of the elevated floor assembly.

In another example, the customary floor covering and the finishing strip are replaced by a flexible, slightly resilient floor covering material, such as carpeting, which covers the upper surface of a core and extends downwardly around all core edges and inwardly for a short distance along the bottom surface of the core. See U.S. Pat. No. 3,681,882 (BETTINGER). The arrangement is said to provide a substantially air-tight panel-to-panel joint, to reduce the dimensional tolerance requirements for the core, to accommodate panel size variations, and allows easy removal and replacement of the floor panel. However, the arrangement is used solely in those situations where carpeting may be used. Where vinyl tile covering is desired, the arrangement cannot be used.

SUMMARY OF THE INVENTION

The principal object of this invention is to provide a floor panel having a unique flexible edge construction which permits accurate alignment of the floor panels in a floor assembly by accommodating panel size variations due to manufacturing tolerances and by precluding any accumulation of creep along the width and length of the floor assembly, which normally is produced by panel size or panel placement variations.

Another object of this invention is to provide a floor panel having a unique flexible edge construction which facilitates removal and installation of the floor panel, the floor panel being replaceable in the floor assembly irrespective of its original position.

Still another object of this invention is to provide a floor panel having a unique flexible edge construction which cooperates with the flexible edge constructions of like adjacent panels to provide sealed panel-to-panel joints, thereby allowing the chamber beneath the floor assembly to be used as a plenum to distribute conditioned air throughout the floor assembly.

Still another object of this invention is to provide a floor panel having a unique flexible edge construction which cooperates with the flexible edge constructions of like adjacent panels to provide sealed panel-to-panel joints, thereby minimizing noise transmission from the plenum below to the occupied space above, and minimizing noise transmission through the flanking paths provided by the plenum at partition walls.

Still another object of this invention is to provide an improved elevated floor assembly wherein horizontal thrust loads applied to one panel is resisted solely by the pedestals supporting that panel, and such that the horizontal thrust loads are not transferred from that panel to the next-in-line panel.

This invention is directed to an improved floor panel for use in elevated floor assemblies. The present panel comprises generally rectangular upper and lower facing sheets which are laminated to the opposite faces of a relatively incompressible core. The floor panel presents upper and lower faces and contiguous side and end faces. In accordance with this invention, the floor panel includes a relatively thin, flexible strip which extends along the side and end faces around the entire perimeter of the floor panel. The flexible strip projects laterally outwardly from and is generally normal to the side and end faces. The distance between the side faces and between the end faces determines the nominal size of the panel which, of course, may vary due to manufacturing tolerances. The flexible strip, projecting laterally outwardly from the side and end faces, enlarges the nominal size of the floor panel. But since the strip is flexible, it will overlap the flexible strips of adjacent panels thereby accommodating any panel size variations and provide substantially air-tight panel-to-panel joints.

Further in accordance with this invention, an improved elevated floor assembly is provided comprising a subfloor, plural pedestals spaced about the subfloor and terminating in panel supporting head assemblies, and plural panels, each presenting upper and lower faces, contiguous side and end faces; and a relatively thin flexible strip extending along the side and end faces around the entire perimeter of the panel and projecting laterally outwardly from and generally normal to the side and end faces. The arrangement is such that each panel is supported by adjacent head assemblies in vertically spaced relation with the subfloor, with the side and end faces thereof spaced-apart from the corresponding side and end faces of adjacent panels but with the flexible strips thereof in edge-overlapped relation with the flexible strips of the adjacent panels.

DESCRIPTION OF THE PREFERRED EMBODIMENT(S)

Figure 1:
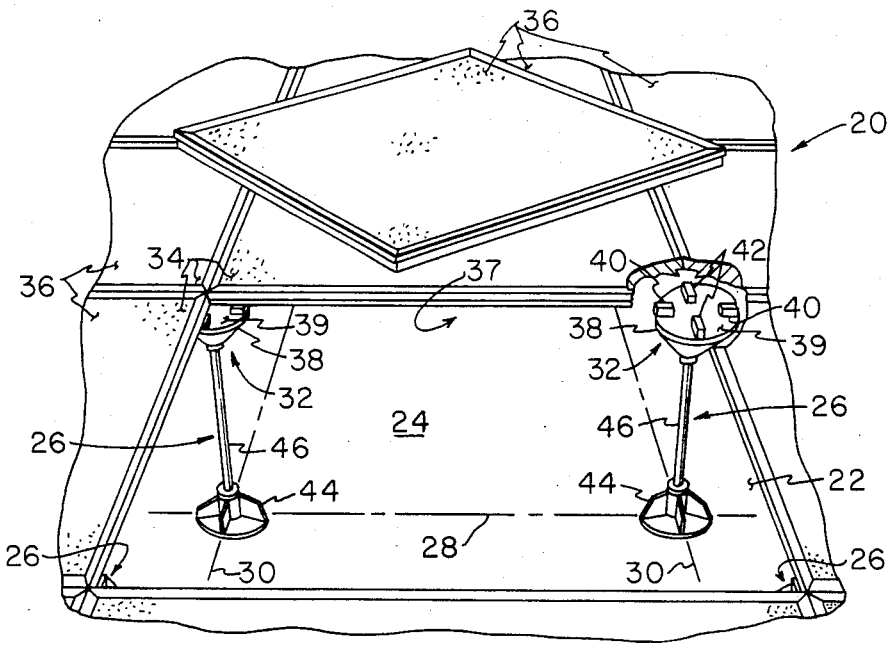
FIG. 1 is a fragmentary perspective view of an elevated floor assembly with a floor panel removed to expose the support pedestals.

FIG. 1 illustrates a fragmentary perspective view of an elevated floor structure identified generally by the numeral 20. The floor structure comprises a subfloor 22 presenting an upper surface 24 on which plural pedestals 26 are secured. Each of the pedestals 26 is positioned at a location defined by mutually perpendicular grid lines 28, 30 provided on the upper surface 24. Each of the pedestals 26 terminates in a panel supporting head assembly 32 adapted to support corners 34 of adjacent floor panels 36. The floor panels 36 are supported in vertically spaced relation with the subfloor 22 to define a chamber 37 therebetween.

The pedestals 26 preferably comprise that pedestal described and claimed in copending U.S. patent application Ser. No. 676,449 filed Nov. 29, 1984 which is a continuation of Ser. No. 480,577 filed Mar. 30, 1983 and now abandoned, and assigned to the Assignee of this invention—application Ser. No. 676,449 being incorporated herein by reference. For a complete description of the pedestal, reference is directed to the aforesaid application Ser. No. 676,449, now U.S. Pat. No. 4,558,544. However for the purposes of this invention, it is deemed sufficient to state that the head assembly 32 includes a head member 38 the top surface of which is covered by cushioning means, such as a cushioning pad 39 (see FIG. 9). The head member 38 presents sets of mutually perpendicular, radially extending, upstanding lugs 40, 42 arranged such that adjacent lugs 40, 42 receive and retain a corner 34 of the floor panels 36. Each head member 32 is secured to the upper end of a support rod 46. The support rod 46 extends upwardly from a base member 44. During installation, each base member is positioned accurately with respect to the grid lines 28, 30. While not discernible from FIG. 1, each head member 38 includes abutment means to establish the required height of the head member 38 above the upper surface 24. The head member 38 can, during installation, be rotated about the support rod 46 and can be displaced laterally in all directions relative to the support rod 24 to align the lugs 40, 42 with the grid lines 28, 30. The ability of the head member to be displaced laterally in all directions relative to the support rod 46, accommodates any inadvertent misalignments between the base member 44 and the grid lines 28, 30. Clamping means is provided for clamping the head member 32 in fixed orientation relative to the grid lines 28, 30.

Figure 2:
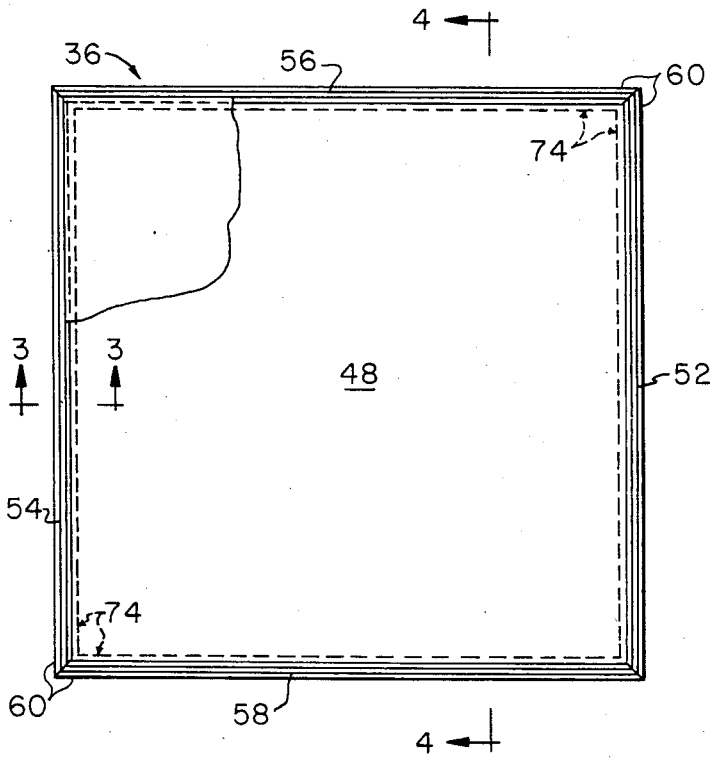
FIG. 2 is a plan view of the floor panel of this invention.

Referring to FIG. 2, the present floor panel 36, has a generally rectangular configuration and presents upper and lower faces 48, 50 (the lower face 50 not being visible); and the contiguous side and end faces designated generally by the numerals 52, 54 and 56, 58. A relatively thin, flexible strip 60 is provided which extends along the side and end faces 52, 58 around the entire perimeter of the panel 36. As will become apparent later in the specification, the flexible strip 60 projects laterally outwardly from the side and end faces 52, 58 and serves as a flexible extension of the panel 36. The flexible strip 60 is adapted to accommodate manufacturing tolerances in the size of the panel and to form substantially air-tight panel-to-panel joints.

In one preferred embodiment, the floor panel 36 (FIG. 3) comprises generally a rectangular upper and lower facing sheets 61, 62 which are laminated to opposite faces of a relatively incompressible core 64, for example, by means of adhesive provided in the form of sheets 66. The facing sheets 61, 62 include perimeter flanges 68, 70 respectively, which extend inwardly toward but outboard of the core 64, and which are provided with embossments 72. Perimeter frame members 74 surround the core 64. Each frame member 74 presents upper and lower grooves 76, 78 positioned to receive the facing sheet flanges 68, 70; and an upwardly opening perimeter recess 80 adapted to receive and retain a flexible strip assembly 82 which carries the flexible strip 60.

The combined width of the embossments 72 and each of the facing sheet flanges 68, 70 is greater than the width of the corresponding groove 76, 78 of the frame members 74. Consequently, the embossments 72 frictionally retain the facing sheet flanges 68, 70 in the corresponding grooves 76, 78. When forming the facing sheet 61 (or 62), the distance between the outer faces of opposite flanges 68 (or 70) is held at relatively close tolerances. When the flanges 68 (70) of the facing sheet 61 (62) are introduced into the grooves 76 (78), the opposite frame members 74, for example those associated with the opposite side faces 52, 54 of the floor panel 36 (FIG. 2), are automatically positioned at the required width (or length) W, L as specified in FIG. 4.

Figure 3:
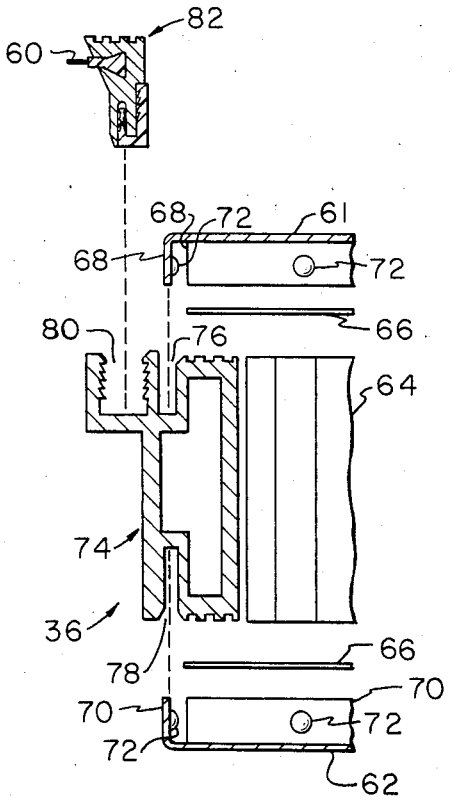
FIG. 3 is a fragmentary cross-sectional view, taken along the line 3—3 of FIG. 2, illustrating the components of the present floor panel.
Figure 5:
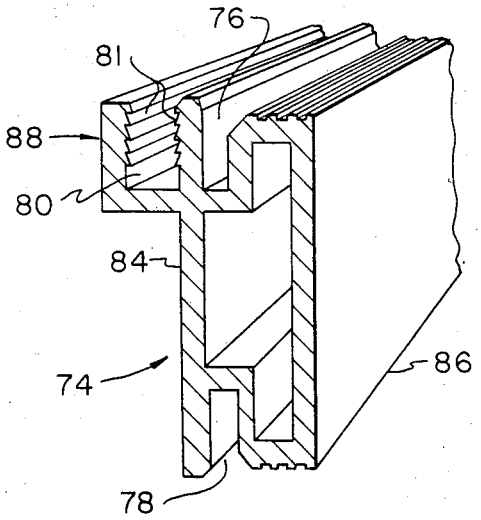
FIG. 5 is a fragmentary perspective view of a frame member.

Referring to FIG. 5, each frame member 74 comprises a central wall 84, an inboard frame portion 86 which cooperates with the central wall 84 to define the upper and lower grooves 76, 78 and an outboard frame portion 88 cooperating with the central wall 84 to define the perimeter recess 80. The perimeter recess 80 is provided with confronting serrated faces 81 adapted to frictionally retain the strip assembly 82 (FIG. 3). In the preferred arrangement, each frame member 74 is formed from aluminum preferably by an extrusion process. As can be seen in FIG. 2, the frame members 74 are mitered at the corners of the panel 36.

Figure 6:
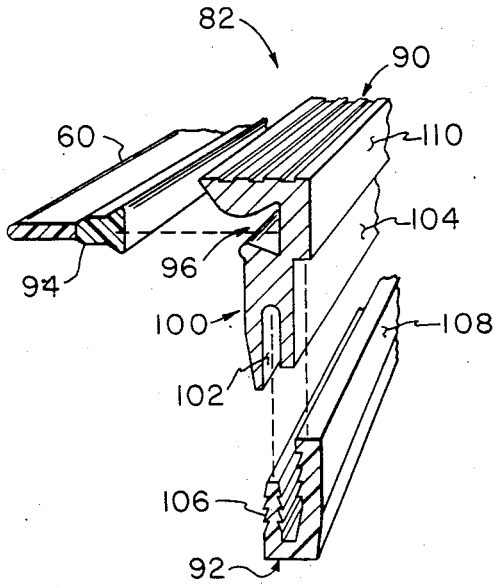
FIG. 6 is a fragmentary exploded view illustrating a preferred embodiment of the flexible strip and rigid carrier member.

Referring to FIG. 6, the flexible strip assembly 82 includes the flexible strip 60, a rigid carrier member 90 and a generally U-shaped spacer 92.

Figure 7:
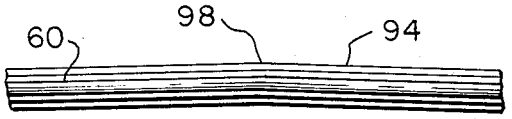
FIG. 7 is a fragmentary side view of a flexible strip which has been bent to promote retention thereof in a rigid carrier member.

The flexible strip 60 includes an enlarged inboard strip portion 94 which is received in and retained by a lengthwise groove 96 presented by the rigid carrier 90. The flexible strip 60 and the inboard strip portion 94 preferably comprise a single piece of dual-durometer plastic material, the flexible strip 60 being formed from flexible plastic material and the inboard strip portion 94 being formed from rigid plastic material. The inboard strip portion 94 is intended to fit snugly within the lengthwise groove 96. However due to manufacturing tolerances, the fit may not be as tight as desired. In the instance of a loose fit, the inboard strip portion 94 should be kinked slightly as shown at 98 in FIG. 7, at a location intermediate of its ends. Once introduced into the lengthwise groove 96, the kink 98 will preclude inadvertent and free removal of the inboard strip portion 94. Alternatively, the inboard strip portion 94 may be secured in the groove by any suitable means, such as an adhesive.

The rigid carrier member 90 includes a bifurcated lower end 100 including a vertical groove 102, an upper inboard face 110, and a lower inboard face 104 which is inset from the face 110. The U-shaped spacer 92 presents first and second vertical arms 106, 108. The first vertical arm 106 is provided with serrations on opposite faces thereof to promote frictional retention thereof within the vertical groove 102. The width of the second vertical arm 108 is greater than the distance at which the lower inboard face 104 is inset from the upper inboard face 110. The arrangement is such that the combined width of bifurcated lower end 100 and the spacer member 92 is greater than the width of the recess 80, to assure a good frictional engagement and retention of the strip assembly 82 in the perimeter recess 80.

Figure 4:
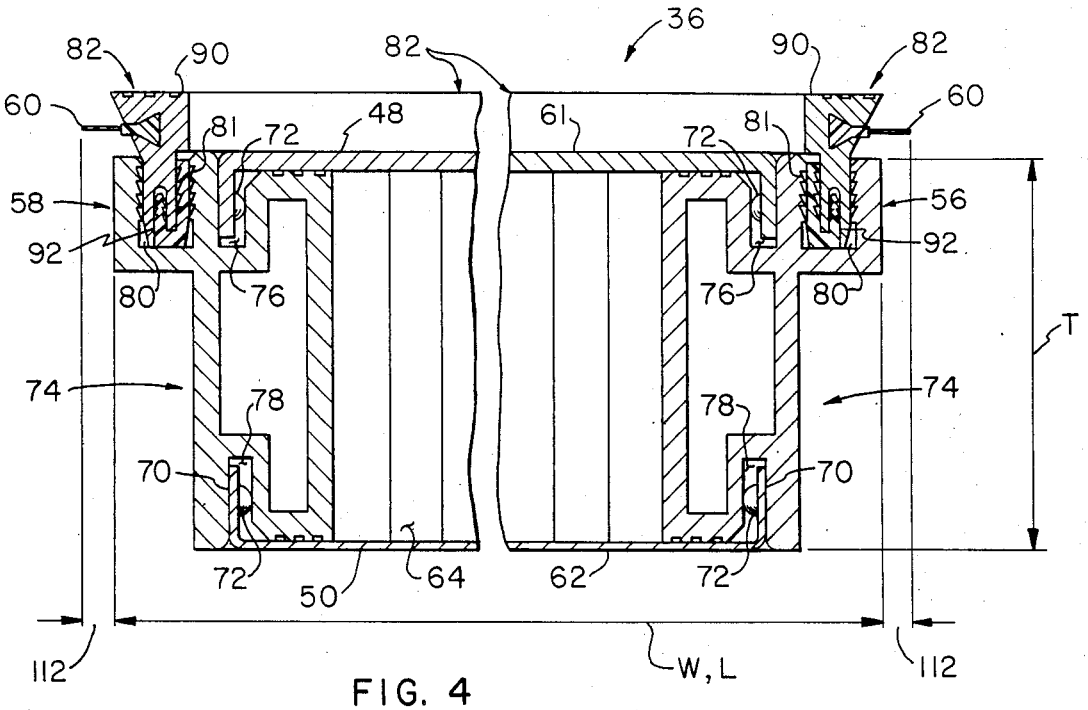
FIG. 4 is a broken cross-sectional view taken along the line 4—4 of FIG. 2.

In FIG. 4, the thickness, width and length of the floor panel 36 are indicated by the dimension lines T and W, L. The width and length W, L may be different or identical. It will be observed that each of the flexible strips 60 projects outwardly beyond the corresponding end face 56, 58 (and beyond the side face 52, 54) by a distance indicated by the dimension 112 and constitutes a flexible extension of the panel 36.

Figure 8:
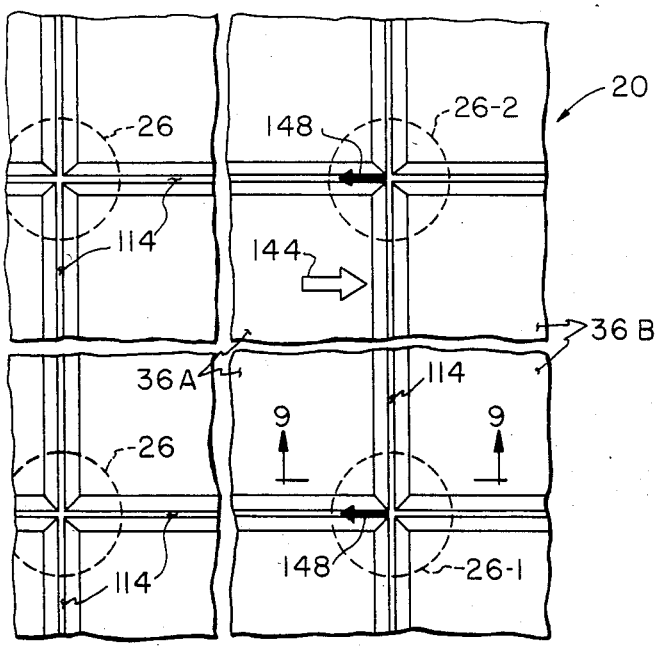
FIG. 8 is a fragmentary, broken plan view of the elevated floor ssembly of FIG. 1.
Figure 9:
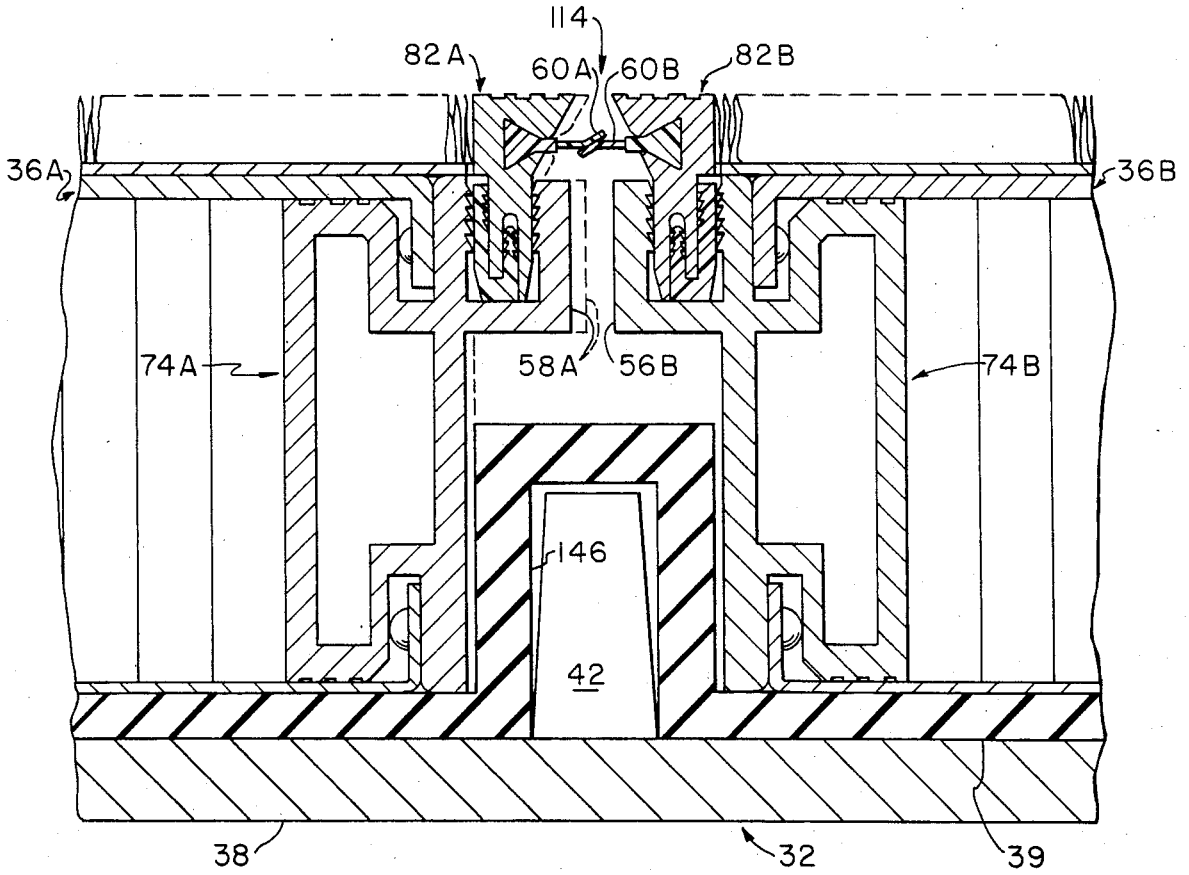
FIG. 9 is a fragmentary cross-sectional view taken along the line 9—9 of FIG. 8.

FIG. 8 illustrates a fragment of the floor structure 20 of FIG. 1, wherein the panels 36 are assembled in side-by-side relation and are supported at the corners by the pedestals 26. Panel-to-panel joints 114 are formed between adjacent panels 36. FIG. 9 illustrates adjacent panels 36A, 36B supported by the pedestal 32 and forming the joint 114. The panels 36A, 36B overlie the cushioning pad 39, and are separated by the lug 42 and the covering segment of the cushioning pad 39. It will be observed in FIG. 9 that the floor panel 36A is supported with the end face 56A thereof spaced-apart from the corresponding end face 58B of the adjacent panel 36B; and with the flexible strip 60A thereof in edge-overlapped relation with the flexible strip 60B of the adjacent panel 36B. The strips 60A, 60B span the distance between the confronting end faces 56A, 56B and are overlapped thereby forming the joint 114 which is substantially air-tight.

The flexibility and lateral projection of the strips 60A, 60B overcome several disadvantages exhibited by prior art floor panels. For example, the panels 36 may be accurately aligned relative to each other during installation to accommodate any inadvertent misalignment of the pedestals 26. During installation and alignment the air-tight joint 114 is automatically formed. Any variations in the size of the panels due to manufacturing tolerances also is automatically accommodated. The accumulation of creep in the fore-and-aft and side-to-side runs of the panels also is precluded—the arrangement being capable of complying with the stringent allowable creep ratio of 1/2500. Since each panel is resiliently engaged with the adjacent panels, removal of any particular panel is easily accomplished. When a number of the panels is removed to gain access to chamber 37, each panel may be replaced irrespective of its original position. Since the panels are completely interchangeable, the need to mark or otherwise identify each panel for replacement in its original position is completely eliminated. The overlapped strips 60A, 60B also act as an acoustic seal which reduces significantly the transmission of air-borne sound from the chamber 37 to the space above the floor assembly 20. It will also be appreciated that since the panels are physically separated from each other, hard transmission of sound from panel-to-panel is also prevented. This is particularly important in installations where a panel extends beneath a partition.

Another important feature of this invention is that the joints 114 serve as load breaks which preclude the transfer of horizontal thrust loads from one panel, to the next panel, to the next panel, etc. along the floor assembly. Referring to FIG. 8, a horizontal thrust load represented by the arrow 144 is applied, for example, to the panel 36A. The thrust load 144 may cause the panel 36A to move, as shown in FIG. 9, from the full-line position to the dashedline position, that is laterally to the right. The panel 36A may move enough to engage the cushioning pad segments 146 which covers the lugs 42. As a result, the thrust load 144 will be resisted solely by the pedestals 26-1 and 26-2 (FIG. 8)—the resisting forces being represented by the arrows 148. It will be appreciated that since the overlapped flexible strips 60A, 60B constitutes the only contact between the panels 36A, 36B, the thrust load 144 is not and cannot be transferred to the adjacent panel 36B. Thus the thrust load applied to a panel is resisted solely by the pedestals supporting that panel and is not transferable to the adjacent panels.

The present invention contemplates the manufacture of the panel 36 to relatively close tolerances. For example, in a commercial embodiment, the floor panel 36 had a nominal width and length of 1200 mm and was manufactured with an actual width and length of 1197 mm with a tolerance range of +0.0 mm, −1.0 mm; and had a thickness of 45 mm with a tolerance range of +0.4 mm, −0.2 mm. The upper sheet 61 was formed from an aluminum alloy sheet having a minimum thickness of 2.03 mm. The lower facing sheet 62 was formed from an aluminum alloy sheet having a minimum thickness of 1.12 mm. The core 64 comprised a honeycomb core having a height of 41.9 mm with a tolerance range of +or −0.127 mm. The honeycomb core was formed from perforated aluminum foil having a nominal thickness of 0.1143 mm and a minimum thickness of 0.102 mm. The cell size of the honeycomb core was 12.7 mm measured across the flats of the cells. The flexible strip 60 projected beyond each of the side and end faces 52, 58 by 3.8 mm giving the floor panel 36 an overall width and length of 1204.6 mm.

It should be appreciated at this time that the present invention provides a floor panel for an elevated floor assembly which is of a size heretofore not attempted. For example, prior art panels normally are provided in a size of 18" (457 mm) and 24" (610 mm). The present floor panel 36 having an area of about 1.44 square meters, represents an increase of 6.9 and 3.9 times that of the 18" and 24" prior art panels, respectively.

In addition, the commercial embodiment described above weighed approximately 20.4 kg, was capable of supporting point loads of at least 510 kg with a safety factor of two and had a design load of 513 kg per square meter plus a partition load at mid span of 204 kg per lineal meter.

Alternative embodiments of the present invention will now be described with reference to FIGS. 10 through 14.

Figure 10:
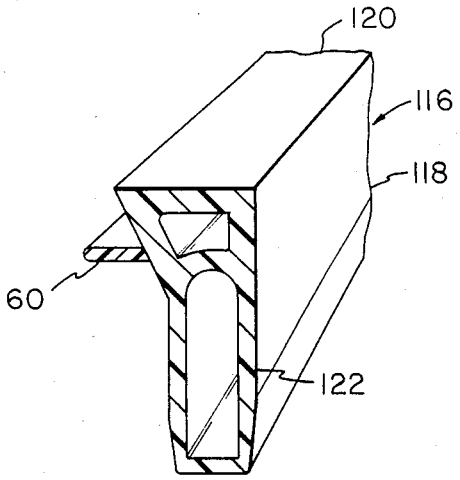
FIG. 10 is a fragmentary perspective view illustrating an alternative embodiment of the flexible strip.
Figure 11:
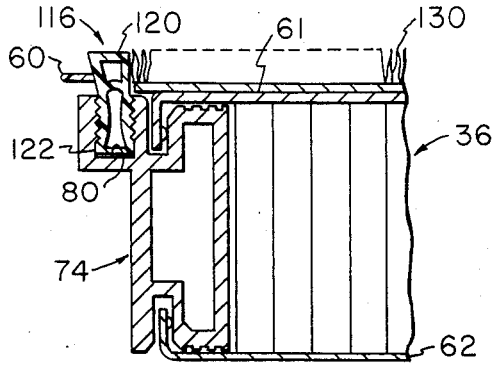
FIG. 11 is a fragmentary cross-sectional view similar to FIG. 4, illustrating a floor panel incorporating the flexible strip of FIG. 10.

FIG. 10 illustrates a one-piece strip assembly 116 formed from dual-durometer plastic material to include the strip 60 of flexible plastic material and an inboard strip portion 118 of rigid plastic material. The inboard strip portion 118 includes an upper portion 120 and a lower portion 122. As seen in FIG. 11, the lower portion 122 is frictionally retained in the upwardly opening perimeter recess 80. The upper portion 120 projects above the upper face of the upper facing sheet 61 and serves as a decorative perimeter strip and as a stop for decorative covering, such as carpeting 130.

Figure 12:
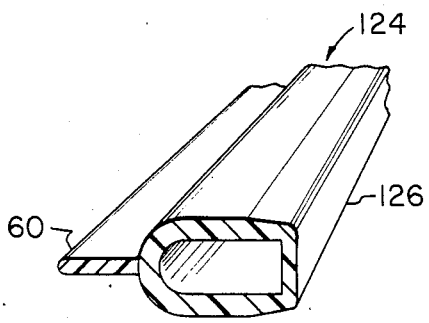
FIG. 12 is a fragmentary isometric view illustrating a further alternative embodiment of the flexible strip.
Figure 13:
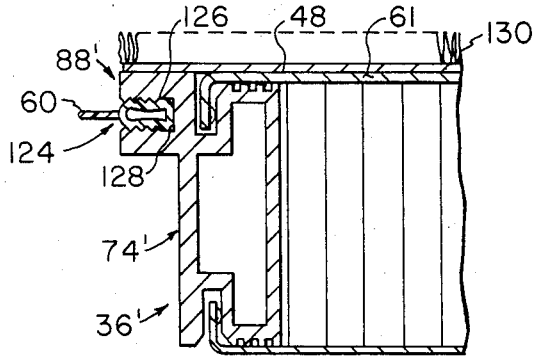
FIG. 13 is a fragmentary cross-sectional view, similar to FIG. 11, illustrating a floor panel incorporating the flexible strip of FIG. 12.

FIG. 12 illustrates a one-piece strip assembly 124 preferably formed from dual-durometer plastic material to include the strip 60 of flexible plastic material and an inboard strip portion 126 of rigid plastic material. The strip assembly 124 provides an in-line arrangement for the flexible strip 60 and the inboard strip portion 126. The strip assembly 124 is adapted for use in the floor panel 36' illustrated in FIG. 13, wherein the frame members 74' include an outboard frame portion 88' presenting a laterally outwardly opening perimeter recess 128. The perimeter recess 128 receives and frictionally retains the inboard strip portion 126 of the strip assembly 124. The flexible strip 60 and the inboard portion 126 are disposed below the upper face 48 of the floor panel 36'. The arrangement is such that the carpeting 130 covers the entire upper face 48 of the floor panel 36.

Figure 14:
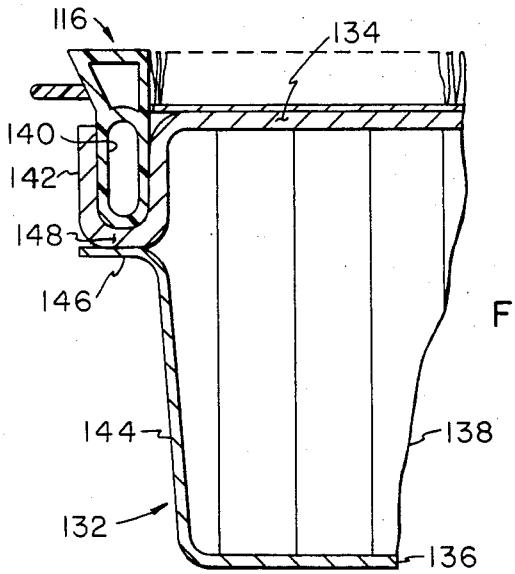
FIG. 14 is a fragmentary cross-sectional view, similar to FIG. 13, illustrating an alternative embodiment of the floor panel incorporating the flexible strip of FIG. 10.

FIG. 14 illustrates a floor panel 132 formed from upper and lower facing sheets 134, 136 which are laminated to a relatively incompressible core 138. The upper and lower facing sheets 134, 136 are deep drawn pans. The upper facing sheet 134 presents an upwardly opening perimeter recess 140 formed by a U-shaped panel edge 142. The bottom facing sheet 136 includes an upwardly and outwardly diverging sidewall 144 terminating in a laterally outwardly extending flange 146 which engages the bight 148 of the U-shaped panel edge 142 and which may be secured thereto by means (not shown), such as, tack welding or an adhesive. The perimeter recess 140 is adapted to receive and frictionally retain the strip assembly 116 with the flexible strip 60 thereof projecting laterally outwardly beyond the U-shaped panel edge 142.

We claim:

1. A floor panel for use in elevated floor assemblies, comprising:

generally rectangular upper and lower facing sheets laminated to opposite faces of a relatively incompressible core;

said panel having an upper face and a lower face and contiguous side and end faces;

a relatively thin, flexible strip extending along said side and end faces around the perimeter of said panel, said flexible strip projecting laterally outwardly from and generally parallel with said upper face of said panel;

said upper and lower facing sheets including perimeter flanges extending inwardly toward but outboard of said incompressible core;

perimeter frame members surrounding said core and receiving said flanges; and said flexible strip being provided in plural strips, one carried by each of said frame members and extending substantially the entire length thereof.

2. The floor panel as defined in claim 1 wherein said flexible strip includes an inboard strip portion, and said panel presents a perimeter recess captively retaining said inboard strip portion.

3. The floor panel as defined in claim 2 wherein said recess is parallel with said side and end faces; and wherein said inboard strip portion extends above the upper face of the upper facing sheet and serves as a decorative cover stop.

4. The floor panel as defined in claim 2 wherein said recess is normal to said side and end faces; and wherein said flexible strip and said inboard strip portion are disposed below said upper face of said panel.

5. The floor panel as defined in claim 2 wherein said flexible strip and said inboard strip portion comprise a single piece of dual-durometer plastic material, said inboard strip portion being formed from rigid plastic material.

6. The floor panel as defined in claim 1 including a rigid carrier member connected to said side and end faces and having a lengthwise groove; and said flexible strip presents an inboard strip portion captively retained in said lengthwise groove.

7. The floor panel as defined in claim 6 wherein said panel member presents a perimeter recess captively retaining said carrier member.

8. The floor panel as defined in claim 9 wherein each said inboard strip portion extends above the upper face of the upper facing sheet and has an inboard face spaced from and generally normal to the upper facing sheet, the inboard faces serving as a decorative cover stop.

9. The floor panel as defined in claim 8 wherein each of said perimeter frame members presents an upwardly opening perimeter recess, and wherein each of said flexible strips includes an inboard strip portion captively retained by one said perimeter recess.

10. The floor panel as defined in claim 9 wherein said flanges of the upper and lower facing sheets include embossments which promote frictional engagement of said flanges in said upper and lower grooves.

11. The floor panel as defined in claim 1 wherein each of said frame members presents a laterally outwardly opening recess; and wherein the flexible strip and the associated inboard strip portion reside below the level of the upper face of the upper facing sheet.

12. The floor panel as defined in claim 1 wherein each of said frame members comprises:

a central wall positioned outboard of said flanges;

an inboard frame portion cooperating with said central wall to define upper and lower grooves captively receiving said flanges; and an outboard frame portion cooperating with said central wall to define a perimeter recess captively retaining a segment of the associated flexible strip.

* * * * *